US005984346A

United States Patent [19]

Keller

[11] Patent Number: 5,984,346

[45] Date of Patent: Nov. 16, 1999

[54] BINDING FOR SNOWBOARDS OR THE LIKE

[75] Inventor: Alexander Keller, Unterammergau, Germany

[73] Assignee: Marker Deutschland GmbH, Germany

[21] Appl. No.: 08/890,082

[22] Filed: Jul. 9, 1997

[30] Foreign Application Priority Data

Jul. 11, 1996 [DE] Germany ..... 196 27 808

[51] Int. Cl.[6] ..... A63C 9/10

[52] U.S. Cl. ..... 280/634; 280/607; 280/624; 280/618

[58] Field of Search ..... 280/624, 613, 280/617, 618, 629, 630, 634, 14.2; 249/147

[56] References Cited

U.S. PATENT DOCUMENTS

| | | | |
|---|---|---|---|
| 5,188,386 | 2/1993 | Schweizer . | |
| 5,354,088 | 10/1994 | Vetter et al. | 280/618 |
| 5,356,170 | 10/1994 | Carpenter et al. | 289/618 |
| 5,499,837 | 3/1996 | Hale et al. | 280/607 |
| 5,577,755 | 11/1996 | Metzger et al. | 280/607 |
| 5,586,779 | 12/1996 | Dawes et al. . | |
| 5,762,358 | 6/1998 | Hale | 208/607 |

FOREIGN PATENT DOCUMENTS

| | | |
|---|---|---|
| 2 702 388 | 3/1993 | France . |
| 2 726 480 | 12/1995 | France . |
| 42 19 036 A 1 | 1/1993 | Germany . |
| 94 06 441 | 6/1994 | Germany . |
| 296 01 721 U 1 | 5/1996 | Germany . |
| WO 94/21339 | 9/1994 | WIPO . |
| WO 96/29126 | 9/1996 | WIPO . |

*Primary Examiner*—Robert J. Oberleitner
*Assistant Examiner*—Daniel Yeagley
*Attorney, Agent, or Firm*—D. Peter Hochberg

[57] ABSTRACT

A binding for a snowboard including a base plate having a central opening and a fastening plate located inside the central opening. The fastening plate is held to the board by fasteners, which can be moved to different holes in a pattern of holes. A flange plate and a clamping disk are retained to the fastening plate by screw connection sleeves threaded into threaded bolt holes located on the fastening plate. A spring located on the fastening plate tries to lift the flange plate and the clamping disk in the vertical direction. The clamping disk includes arcuate concentric slots having a ramp-like bearing surface conforming to heads on the screw connection sleeves having convex undersides. The clamping disk has a first rotational position and a second rotational position. The first rotational position forces a toothing arrangement located at the peripheral outer edge of the flange plate to engage a mating toothing arrangement on the base plate and holding the base plate in a non-rotatable position. The second rotational position causes the toothing arrangement in the flange plate to disengage the toothing arrangement in the base plate allowing the base plate to rotate.

13 Claims, 2 Drawing Sheets

BINDING FOR SNOWBOARDS OR THE LIKE

BACKGROUND OF THE INVENTION

1. Field of the Invention

The invention relates to a binding for snowboards or the like and in particular to such binding, having a base plate, which is to be arranged on the top side of the snowboard or the like, and a boot-retaining means which is arranged on said base plate, and having a circular flange plate which serves for retaining the base plate on the snowboard or the like, and which flange-plate can be positioned on a circular opening of the base plate and can be connected fixedly to the snowboard or the like, a flange-plate border region which projects beyond the border of the circular opening retaining the base plate in a positively and/or frictionally locking manner and releasingly holding or bracing it on the snowboard or the like.

The invention also relates to the "kinematically reversed" arrangement, in which the base plate is circular and the flange plate is annular, such that a border on the inner circumference of the flange plate projects beyond the outer circumferential border of the base plate, retains the latter in a positively and/or fixedly locking manner and braces it on the snowboard or the like.

2. Discription of the Prior Art

Bindings of the type specified in the introduction are known and are commercially available. The circular flange plate may be fastened on the snowboard in different positions offset relative to one another in the longitudinal and transverse directions of the snowboard, the base plate being clamped fixedly between the top side of the snowboard and a flange-plate border region which engages over a border zone of the circular opening of the base plate. Mating toothing arrangements on the mutually facing end sides of the overlapping border regions of the flange plate and circular opening of the base plate mean that it is also possible for the position of the base plate to be secured by positive locking with the flange plate.

The advantage of this design is that, for the positioning of the flange plates, all that has to be taken into consideration is the desired distance between snowboarder's feet on the snowboard and the positions of the mid-foot regions. The respective rotary setting of the base plate, i.e. the angle position of the longitudinal axis of the base plate and/or of the boot relative to the longitudinal axis of the snowboard, can be set virtually as desired—the fineness of the setting being predetermined by the interengaging toothing arrangements on the flange plate and base plate—before the base plate is braced between the top side of the snowboard and the flange plate.

At the same time, account is taken of the fact that subsequent changing of the rotary position of the base plate is desired comparatively often, whereas changing of the position of the flange plates is only necessary or desirable very occasionally. In order to change the rotary position of the base plate, all that is required is to loosen the respective flange plate to the extent where the frictional and/or positive locking between the two plates is released.

Nevertheless, it is desirable, in particular for snowboards which are used for hiring out to a large number of snowboarders in quick succession, for it to be even easier to change the rotary position of the base plate.

SUMMARY OF THE INVENTION

An object of the present invention is to provide a binding for a snowboard or the like, having apparatus for facilitating the changing of the rotary position of the base plate.

Another object of the invention is the provision of a binding for a snowboard or the like having a base plate, a boot retaining means on the base plate including a flange plate for retaining the base plate on the snowboard or the like and being fixable to the snowboard or the like, wherein the flange plate is vertically movable to enable rotation of the base plate to a desired position.

Yet another object is the provision of a binding for a snowboard or the like having a protective cover for the flange plate and fastening elements or retaining means operating with respect to the flange plate.

These objects are achieved according to the invention by a clamping disk being arranged above the flange plate, by the flange plate being retained on the snowboard or the like such that it is non-rotatable and vertically movable with respect to its vertical axis, and the clamping disk being retained such that it is rotatable and vertically movable with respect to its vertical axis, and by the clamping disk, upon rotation in one direction, being braced increasingly in the axial direction against the flange plate and, upon rotation in the opposite direction, permitting increasing vertical movement of the flange plate.

The invention is based on the general idea of using separate elements to secure the flange plate, on the one hand, with respect to rotation around the vertical axis and, on the other hand, with respect to axial lifting, and of designing the latter fastening elements such that it is possible to change over quickly between axial movement and axial securing of the flange plate.

According to a preferred embodiment of the invention, the flange plate is assigned a resilient lifting arrangement which tries to force the flange plate against the clamping disk and thus to lift it out of positive locking with the base plate.

In a manner which is particularly preferred in design terms, the flange plate and clamping disk are retained on the snowboard or the like by means of common bolts, the bolts passing through, on the one hand, virtually without any radial play, holes which are arranged in the flange plate and, on the other hand, arcuate slots which are arranged in the clamping disk, and heads which are arranged on the bolts interacting with tracks which are provided on the slots and form ramps which rise in one direction of the slots.

This means that the bolts can be retained on a fastening plate which, for its part, can be fastened adjustably on the snowboard or the like and may serve as a rotary bearing of the base plate.

In all the embodiments, the clamping disk may also assume, in addition to its clamping function, the function of a covering for the flange plate, with the result that concave regions of the flange plate and the fastening elements of the latter can be covered over in a manner which keeps out snow and it is more difficult for snow and ice to remain stuck to the mid-foot region of the binding.

A covering plate of this type is also advantageous when, in the conventional manner, screws or the like are used to fasten the flange plate directly on the snowboard or the like.

As regards preferred features of the invention, you are otherwise referred to the claims and to the following explanation of the drawing, with reference to which particularly preferred embodiments and features of the invention are explained.

Figure 1:
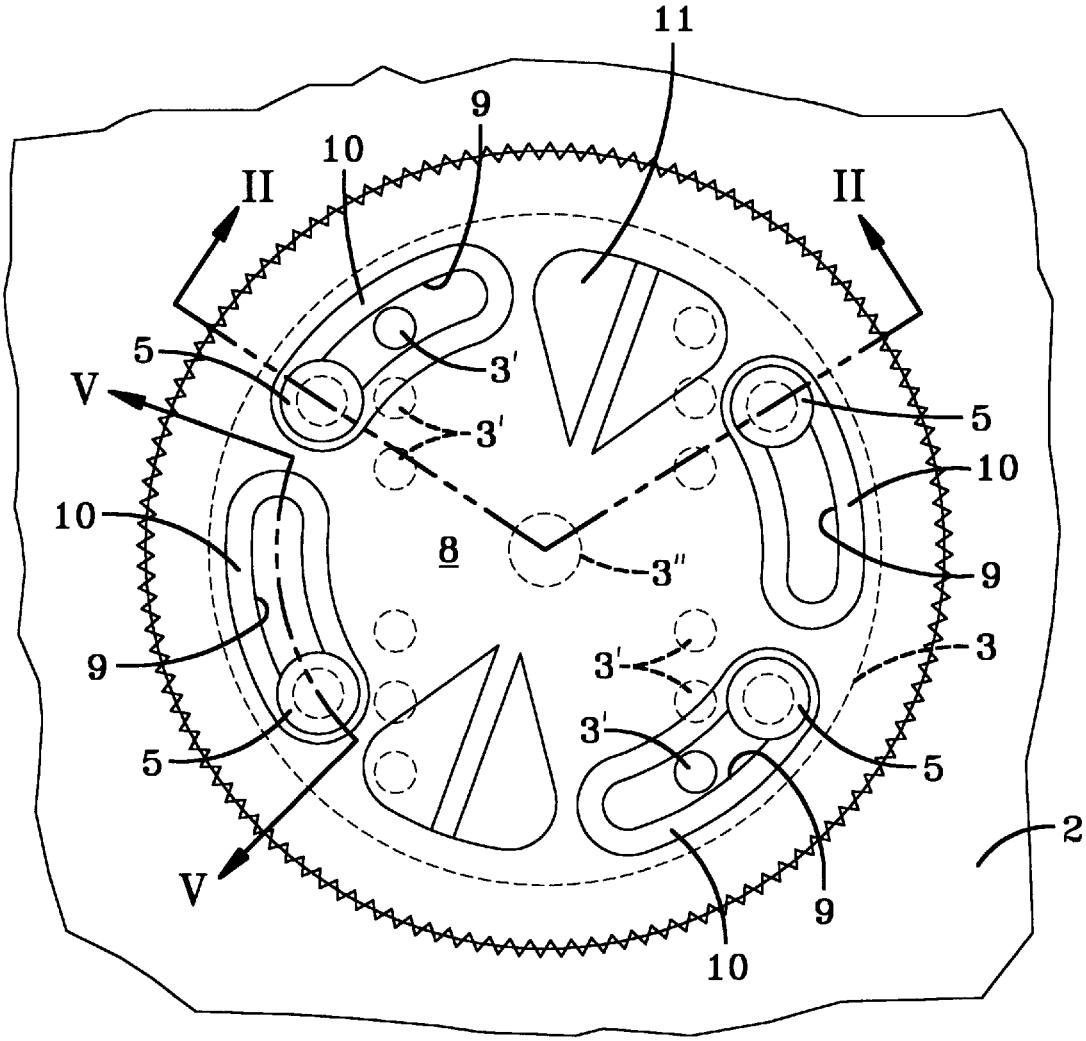
FIG. 1 shows a plan view of the binding in the region of the flange plate.
Figure 2:
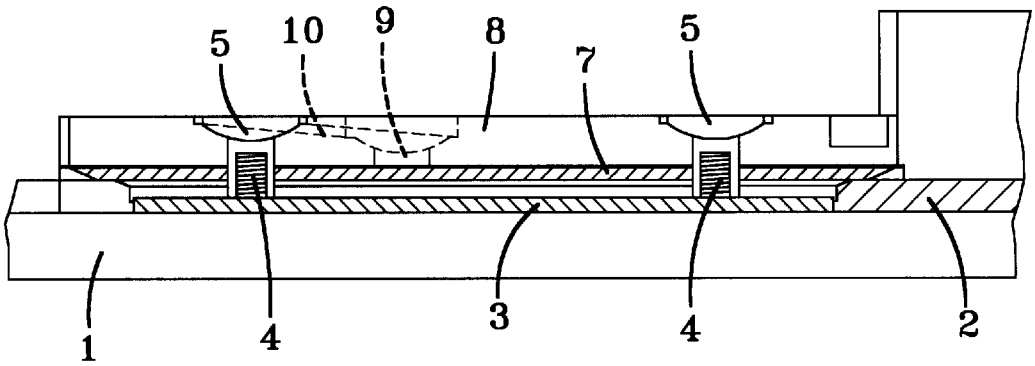
FIG. 2 shows a sectional view along the section line II—II in FIG. 1, the flange plate being illustrated in the braced state.
Figure 3:
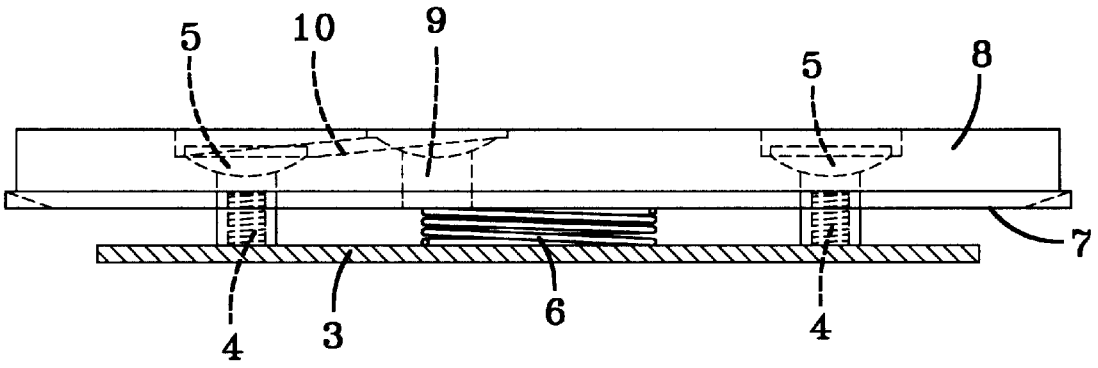
FIG. 3 shows a sectional view corresponding to FIG. 2, with the flange plate in the lifted state.
Figure 4:
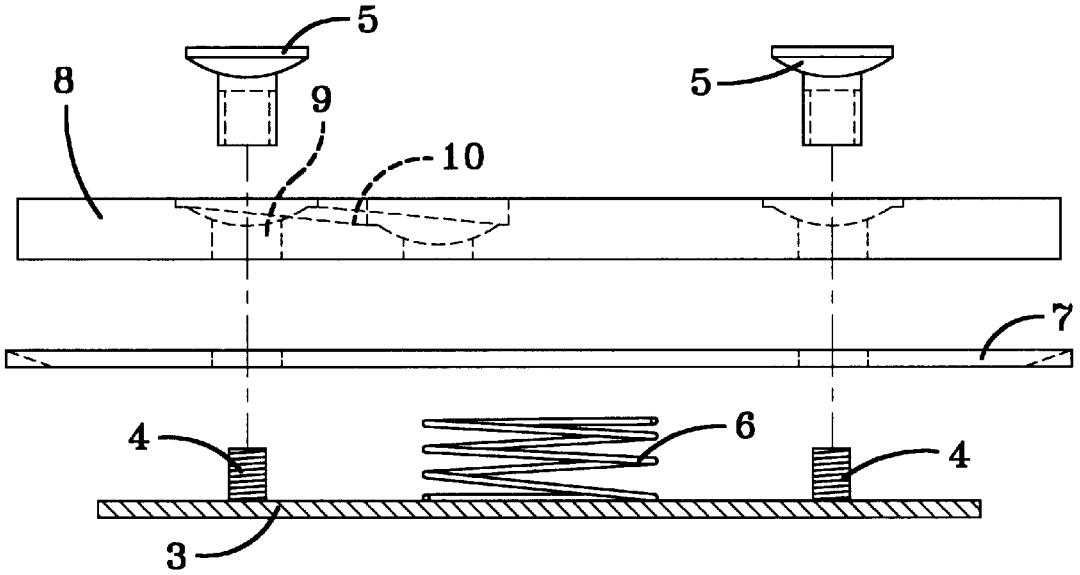
FIG. 4 shows an exploded side view of the fastening plate, flange plate and clamping disk.

The snowboard binding (which is illustrated schematically has a base plate 2 which is to be fitted on the top side of the snowboard 1, bears boot-retaining means (not illustrated) and, in the. mid-foot region, has a large central circular opening, of which the border region is provided with a slightly conical toothing arrangement on the end side.

Arranged within said circular opening is a correspondingly circular fastening plate 3, which can be braced fixedly to the snowboard 1 by means of fastening screws. For the purpose of receiving the fastening screws, the snowboard has conventionally prepared threaded positions or threaded parts which can be subjected to high loading. In order to make it possible for the fastening plate 3 to be retained in different positions relative to the threaded positions or parts in the snowboard 1, a pattern of holes 3' for receiving the fastening screws is provided in the fastening plate 3. A marking which may be provided on the snowboard 1 for the desired position of the fastening plate 3 remains visible through a central opening 3" in the fastening plate 3 when the latter is fitted.

The fastening plate 3 cannot itself retain the base plate 2. Rather, the fastening plate 3 merely forms axial stub or bearing which is very short in the vertical direction and around which the base plate 2 can rotate.

A plurality of threaded stay bolts 4, the example illustrated showing four such bolts, onto which screw-connection sleeves 5 can be screwed are arranged on the fastening plate 3. These screw-connection sleeves 5 have wide-bordered heads with a convex underside which is shaped to correspond to a section of a sphere.

A helical compression spring 6 is arranged in the center of the fastening plate 3.

The screw-connection sleeves 5 screwed onto the threaded stay bolts 4 retain a flange plate 7 and, above this, a clamping disk 8 on the fastening plate 3. The flange plate 7 has appropriate round holes for receiving the screw-connection sleeves 5, through which holes the flange plate 7 is retained on the screw-connection sleeves 5 such that it is non-rotatable but nevertheless axially movable in the direction of the sleeve axes.

The flange plate 7 is dimensioned such that it overlaps the border region of the circular opening of the base plate 2 from above. Arranged on the underside of the border region of the flange plate 7 is a toothing arrangement which mates with the toothing arrangement on the end side of the border region of the circular opening of the base plate 2 and can engage in said toothing arrangement of the base plate 2.

The clamping disk 8 has arcuate slots 9 through which the screw-connection sleeves 5 pass and of which the center of curvature falls in the center of the clamping disk 8. On either side of the slots 9, a bearing surface 10, which in cross-section is in the form of an arc of a circle, is provided for the convex underside of the heads of the screw-connection sleeves 5, to be precise such that these bearing surfaces 10 form ramps which rise in one circumferential direction of the clamping disk 8 and, at their top ends, are lower than the top side of the clamping disk 8 by an amount which corresponds approximately to the height of the heads of the screw-connection sleeves 5.

The helical compression spring 6 tries to lift the flange plate 7 and the clamping disk 8 such that the toothed border of the flange plate 7 tries to disengage from the corresponding mating toothing arrangement of the base plate 2.

Figure 5:
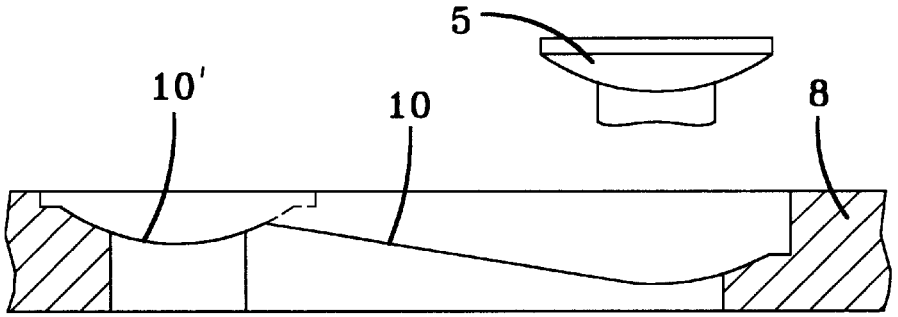
FIG. 5 shows a vertical section along the arcuate center longitudinal axis of a slot in the clamping disk along the section line V—V in FIG. 1.

If, then, the clamping disk 8 is rotated around its center by means of a tool or by being gripped in the grip hollows 11, the heads of the screw-connection sleeves 5, depending on the direction of rotation, pass into that region of the bearing surfaces 10 which is at a higher level with respect to the top side of the clamping disk 8 or into that region thereof which is at a lower level. In the first case, the clamping disk 8 is forced increasingly in the downward direction against the snowboard 1, with the result that the flange plate 7 is pressed down against the snowboard 1 and the base plate 2 is clamped in a frictionally locking manner between the snowboard 1 and flange plate 7, the end-side toothing arrangement of the flange plate 7 simultaneously engaging in the mating toothing arrangement of the base plate 2, so that the base plate 2 is also secured in the respective rotary position by positive locking with the flange plate 7. According to FIG. 5, it is possible for the heads of the screw-connection sleeves 5 at the top end of the bearing surfaces 10, i.e. when the clamping disk has been advanced axially toward the top side of the snow board, to be received by a depression 10' of the bearing surface in the manner of a catch, with the result that the position of the clamping disk 8 is secured "in the manner of a bayonet fastening".

If the clamping disk 8 is rotated in the opposite direction, the heads of the screw-connection sleeves 5 pass into that region of the bearing surfaces 10 which is at a lower level with respect to the top side of the clamping disk 8, with the result that the flange plate 7 and the clamping disk 8 are lifted by the helical compression spring 6, the end-side toothing arrangement of the flange plate 7 disengaging from the mating toothing arrangement of the base plate 2 and it being possible for the base plate 2 to be rotated, on the snowboard 1, around the center of the fastening plate 3.

As a departure from the embodiment illustrated, it is also possible for the helical compression spring 6 to be replaced by another compression-spring element, for example a leaf spring.

If appropriate, it is also possible for such spring elements which force the flange plate 7 and the clamping disk 8 in the upward direction to be dispensed with if the interengaging toothing arrangements of the base plate 2 and flange plate 7 have sufficiently oblique tooth flanks, so that rotation of the base plate 2 is possible as soon as appropriate rotary adjustment of the clamping disk 8 permits sufficient lifting movement of the flange plate 7.

The top side of the clamping disk 8 may carry written information, for example regarding particular properties of the snowboard binding. If appropriate, the attention of the snowboarder may thus be drawn to the fact that snowboard bindings, unlike ski bindings, should not disengage in the event of a fall or collision.

As a departure from the embodiment illustrated, it is also possible for the flange plate 7 to be fastened directly on the snowboard 1. In this case, concave regions and/or fastening elements of the flange plate 7 may be covered over by a covering disk which is arranged in place of the clamping disk 8 and can snap into a central opening of the flange plate 7, for example by means of integrally formed latching hooks. As in the case of the clamping disk 8, it is possible for the covering disk to form, in the mid-foot region of the binding, a smooth surface to which it is difficult for snow or ice to remain stuck.

It is also possible for the covering disk to be arranged on the clamping disk and to cover over the slots 9, the ramp-like sliding tracks 10 and the heads of the screw-connection sleeves.

In place of the grip hollows 11, or in addition to the grip hollows 11, it is possible for the clamping disk 8, or a part which is connected or can be connected thereto in rotationally fixed manner, e.g. the covering disk, to have arranged on it a lever in the form of a handle for rotating the clamping disk 8.

In all the embodiments, the clamping disk 8 should consist of a material which can be subjected to high loading, e.g. metal or (reinforced) plastic.

The invention has been described in detail with particular emphasis on the preferred embodiment thereof, but variations and modifications within the spirit and scope of the invention may occur to those skilled in the art with respect to the foregoing description and the appended claims.

I claim:

1. A binding for snowboards having a top side, said binding comprising:

base plate means attachable to the snowboard and having an opening over the top side of the snowboard when said base plate is attached to the snowboard; and boot retaining means attachable to said base plate means, said boot retaining means including:

flange plate means positionable in said opening, said flange plate means being releasably lockable to said base plate for holding said base plate on the snowboard, said flange plate means being non-rotatable and vertically movable on a vertical axis with respect to the snowboard;

clamping disk means located over said flange plate means and being rotatable and vertically movable with respect to a vertical axis, said clamping disk means including arcuate slots having a center of curvature that is the same as a center of curvature of said rotatable clamping disk said arcuate slots having bearing surfaces forming ramps which rise in one arcuate direction;

lifting means for biasing said flange plate means and said clamping disk means from the snowboard;

bracing means engageable with said arcuate slots for increasing the bracing force between said clamping disk means and said flange plate means when said clamping disk means is rotated in one direction, and enabling the vertical movement of said flange plate means by said lifting means when said clamping disk is rotated in the opposite direction.

2. A binding according to claim 1 wherein the opening in said base plate means is circular and having a border around said opening, and said flange plate means has a border region for releasably engaging said border of said base plate means for holding said base plate means on the snowboard.

3. The binding according to claim 1 and further comprising covering disk means for protectively covering said clamping disk means.

4. The binding according to claim 1 wherein said clamping disk means includes gripping means for the manual rotation of said clamping disk means.

5. The binding according to claim 4 wherein said gripping means is comprised of grip hollows.

6. The binding according to claim 1, and further including fastening plate means located within said opening in said base plate means for enabling the releasably retainable rotation of said base plate means around said fastening plate means.

7. A binding according to claim 6, wherein said lifting means includes spring means located on said fastening plate means for biasing said flange plate means and said clamping disk means from the snowboard.

8. A binding for snowboards having a top side, said binding comprising:

base plate means attachable to the top side of the snowboard, said base plate means having a central opening; and boot retaining means attachable to said base plate means, said boot retaining means including:

flange plate means positionable in said opening and being releasably lockable to said base plate for holding said base plate on the snowboard, said flange plate means being non-rotatable and vertically movable on a vertical axis with respect to the snowboard;

clamping disk means located over said flange plate means and being rotatable and vertically movable with respect to a vertical axis, wherein said flange plate means has bolt holes, and said clamping disk means is rotatable about a center of curvature and further has arcuate slots having a center of curvature, said center of curvature of said slots being the same center of curvature as that of said rotatable clamping disk, said arcuate slots having bearing surfaces forming ramps which rise in one arcuate direction, said bolt holes being alignable with said accurate slots; and said binding further includes bolts dimensioned to fit through said bolt holes and said arcuate slots without radial play and including bolt heads which operatively engage said bearing surfaces for lifting said clamping disk means when said clamping disk means is rotated in said one arcuate direction and for lowering said clamping disk when said clamping disk is rotated in the opposite arcuate direction.

9. The binding according to claim 8 wherein said ramps have a top end having depressions for receiving said heads of said bolts for releasably catching and holding said clamping disk means in a non-rotatable position.

10. The binding according to claim 8 and further including fastening plate means for being adjustably attached to said snowboard, said fastening plate means being positioned below said clamping disk means and said flange plate means for receiving said bolts extending through said clamping disk means and said flange plate means.

11. The binding according to claim 10 wherein said fastening plate means is located within said opening in said base plate means for enabling the releasably retainable rotation of said base plate means around said fastening plate means.

12. The binding according to claim 8 wherein said clamping disk means at least partially protectively covers said flange plate means, said bolt, said bolt holes and said arcuate slots.

13. A binding according to claim 8 and further comprising resilient lifting means for biasing said flange plate means and said clamping disk means from the snowboard.

* * * * *